United States Patent [19]

Werber

[11] Patent Number: 4,558,519

[45] Date of Patent: Dec. 17, 1985

[54] WORKING DEVICE FOR DRESS PATTERNS IN THE FORM OF A TEMPLATE

[76] Inventor: Fred Werber, No. 26a Rahlstedter Bahnhofstrasse, 2000 Hamburg 73, Fed. Rep. of Germany, 045586682

[21] Appl. No.: 539,864

[22] Filed: Oct. 7, 1983

[30] Foreign Application Priority Data

Oct. 13, 1982 [DE] Fed. Rep. of Germany ..... 3237890

[51] Int. Cl.[4] ..... A41H 3/015

[52] U.S. Cl. ..... 33/14

[58] Field of Search ..... 33/14, 15

[56] References Cited

U.S. PATENT DOCUMENTS

| | | | |
|---|---|---|---|
| 1,260,849 | 3/1918 | Zech | 33/14 |
| 4,156,969 | 6/1979 | Werber | 33/14 |
| 4,265,020 | 5/1981 | Werber | 33/14 |

*Primary Examiner*—William D. Martin, Jr.

*Attorney, Agent, or Firm*—John C. Smith, Jr.

[57] ABSTRACT

A working device for dress patterns in the form of a template is provided. The template comprises exchangeable panels which are relatively displaceable on a master panel via slots and can be locked in their adjusted positions by means of retaining elements and is thus an individual reusable template for dress patterns, which makes it possible to achieve an accurate fit which can be changed from time to time according to requirements.

8 Claims, 4 Drawing Figures

WORKING DEVICE FOR DRESS PATTERNS IN THE FORM OF A TEMPLATE

BACKGROUND OF THE INVENTION

This invention relates to a working device for dress patterns in the form of a template, especially for producing bodice parts of garments, to transfer the pattern onto paper or fabric by marking cutting lines.

Dress patterns in the form of paper patterns, with cutting lines being transferred onto fabric, are known. The problem arises, here, that the dimensions are predetermined according to the statistical average values for individual sizes, and it is difficult for a user, who is virtually a layman, to obtain the necessary skill for alteration to make accurately fitting patterns.

SUMMARY OF THE INVENTION

It is, therefore, the object of the present invention to improve the dress patterns of the type mentioned above and to provide a working device for dress patterns in the form of a template which makes it possible to obtain an individually adjustable fit, whilst maintaining the proportions, and which guarantees simple handling.

To attain this object the present invention provides a working device for dress patterns in the form of a template, especially for producing bodice parts of garments, to transfer a pattern onto paper or fabric by marking cutting lines, said working device comprising at least three relatively adjustable and exchangeable parts, i.e. a master panel provided for the neckline and the front and back center seams of a garment and carrying an approximately transversely adjustable upper panel for arm-holes and shoulder seams, and a longitudinally and transversely adjustable lower panel for center seams and back seams as well as for side seams and hem of the overall length of the garment, at least two cross slots being provided in each of the upper and lower panels for guided transverse displacement of said upper and lower panels, in which cross slots engage retaining elements stationary relative to the master panel, and longitudinal slots being provided in the master panel in which additional retaining elements engage for a longitudinal displacement of the lower panel to form a cross guide.

As a result, it is possible to adjust the individual fit in a simple way. It can be used again and again for a basic pattern and be adapted to all fashion changes occurring over a period of time.

A simple embodiment of the invention is one in which the upper and lower panels are arranged to be placed onto the master panel and the lower panel partially covers the upper panel.

To adjust the setting and, if appropriate, to make any changes or to enable original relative arrangements to be used again, markings for adjusting the upper panel according to the bust measurement and for adjusting the lower panel according to the back-length measurement may be arranged on the master panel, and the upper panel may have associated markings for the lower panel in respect of the bust measurement.

The panels may be interconnected by means of rivets for relative pivotal movement, and by means of releasable screws and nuts operating in slots for sliding movement of the panels relative to each other.

A favorable design is provided if the master panel has a holding part which is assigned in parallel and is guided in the manner of a slide on the master panel and which is intended for receiving the retaining elements.

It is envisaged, furthermore, that different upper and lower panels can be used for front or back patterns and to increase the range of garment styles and designs. It is proposed that the master panel and the upper and lower panels have marking orifices for identifying variations of the pattern for necklines, the armholes, darts or the like.

For the easy adjustment of waist and hip size the lower panels are fitted with an additional part which can be swung out laterally and which is arranged so that it can be locked via a pivot point and a slot in the panel by means of an associated retaining element.

The template may be made of cardboard or plastic.

BRIEF DESCRIPTION OF THE DRAWINGS

Some preferred embodiments of the invention will now be described by way of example and with reference to the accompanying schematic drawings in which.

DESCRIPTION OF THE PREFERRED EMBODIMENTS

Figure 1:
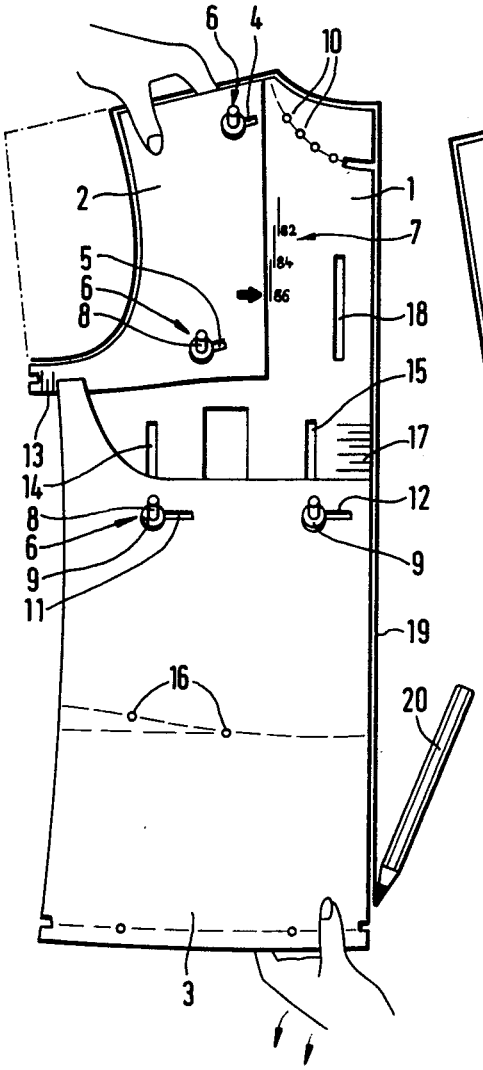
FIG. 1 shows a master panel with an adjusted upper panel for set-in sleeves.

The drawings show a working device according to the invention which comprises a master panel 1 onto which an upper panel 2 and a lower panel 3 are laid in such a manner that the lower panel 3 partially engages over the upper panel 2.

The upper panel 2 is guided on the master panel 1 by cross slots 4 and 5, retaining elements 6 being arranged on the master panel 1. The cross slots 4 and 5 are arranged at an angle according to the shoulder line of the pattern. For the purpose of adjustment, a marking 7 which is identified according to the desired bust measurement is arranged on the master panel 1. The retaining elements 6 on the master panel 1 are designed in the form of screw connections, so that a knob 8 can be locked accordingly by means of a bearing plate 9, and the parts located between them, in this case the master panel 1 and the upper panel 2, are fixed to one another.

Figure 2:
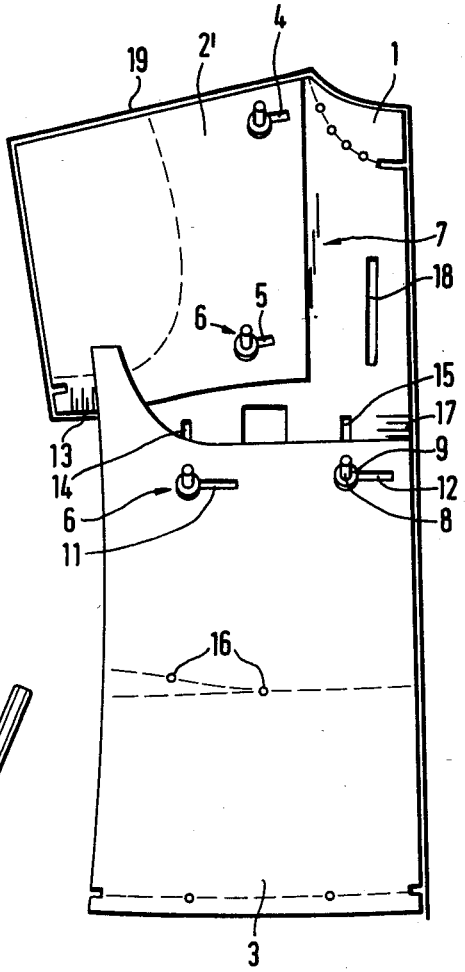
FIG. 2 shows a representation similar to that shown in FIG. 1 but with an upper panel for cut on sleeves.
Figure 3:
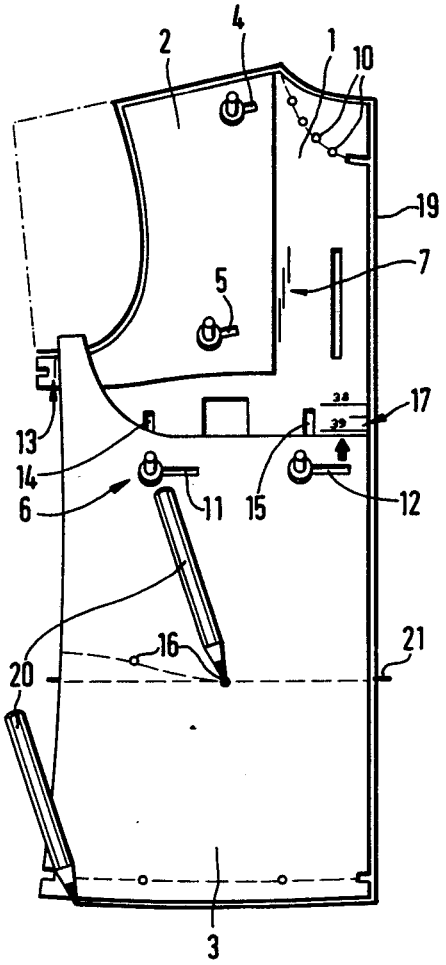
FIG. 3 shows a master panel with adjusted lower panel for the overall length or back length.
Figure 4:
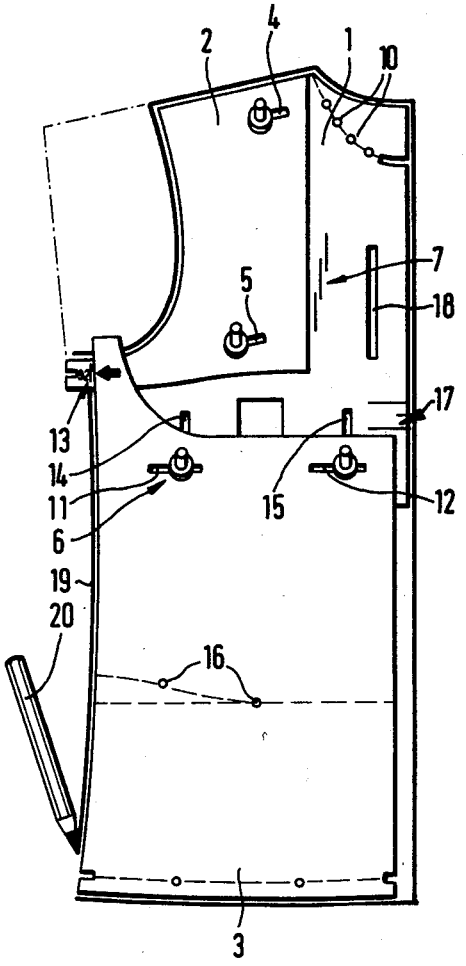
FIG. 4 shows a representation similar to that shown in FIG. 3 with adjusted bust measurement.

According to FIG. 2, alternatively an upper panel 2' for set-in sleeves is connected to the master panel 1. The master panel 1 has in its upper portion marking orifices 10 in the form of an arc of a circle for different necklines and for the front and back pattern, respectively.

Furthermore, the lower panel 3 is likewise arranged via slots 11 and 12 on the master panel 1 by means of retaining elements 6, so that transverse adjustment for the center and back seams and for the side seam becomes possible. At the same time, a marking 13 corresponding to the bust measurement is provided for the purpose of adjustment on the upper panel 2 into which an overlapping part of the lower panel 3 projects. Longitudinal displacement of the lower panel 3 is possible via longitudinal slots 14 and 15 in the master panel 1 to adjust the overall length or, by means of markings 16, to adjust the back length. A marking 17 is located on the master panel 1 for adjustment purposes. Consequently, cross-guidance of the lower panel 3 on the master panel 1 is possible by means of the slots 11, 12 and 14, 15. It is appropriate, in this case, to assign a holding part in parallel to the master panel 1 and to guide it in the manner of a slide in a longitudinal slot 18, the concealed holding part carrying the retaining elements 6 for the lower panel 3 which engage through the slots 11, 14 and 12, 15 respectively.

After the panels 2 and 3 have been adjusted, the cutting lines 19 are marked on paper or fabric by a pencil 20 and important dimensions are marked by the marking orifices 10 and 16 or appropriate points or zones 21.

The invention may be embodied in other specific forms without departing from the spirit or essential characteristics thereof. The embodiments are therefore to be considered in all respects as illustrative and not restrictive.

What is claimed is:

1. A dress pattern template for transferring a pattern onto paper or fabric in the production of bodice parts of garments, said template comprising:

(a) a longitudinally extending master panel, having upper and lower sides and lateral sides extending between said upper and lower sides, including first guide means at one of said lateral sides for marking lines for a portion of the center seams and second guide means at said upper side adjacent said one lateral side for marking lines for the necklines and the adjacent portion of the shoulder seams;

(b) an upper panel, having upper and lower sides and lateral sides extending between said upper and lower sides, including third guide means at said upper side for marking lines for the remainder of the shoulder seams and fourth guide means at one of said lateral sides for marking lines for arm holes;

(c) first adjustable mounting means for adjustably securing said upper panel to said master panel such that said upper panel extends beyond the lateral side opposite said one lateral side of said master panel and said second and third guide means for marking lines for the shoulder seams extend in a straight line, said first mounting means being arranged to guide adjustable movement of said upper panel along a path transverse to the longitudinal axis of said master panel and substantially parallel to said second and third guide means for marking lines for the shoulder seams such that said second and third guide means are maintained in a straight line;

(d) a lower panel, having upper and lower sides and lateral sides extending between said upper and lower sides, including fifth guide means at one lateral side for marking lines for the remainder of the center seams, a sixth guide means at the other lateral side opposite said one lateral side for marking lines for the side seams, and seventh guide means at said lower side for marking the hem;

(e) second adjustable means for adjustably securing said lower panel to said master panel such that said lower panel extends beyond said lower side of said master panel, said fifth guide means is substantially parallel to said first guide means, and at least a portion of the upper side of said lower panel overlaps said lower side of said upper panel, said second mounting means being arranged to guide adjustable movement of said lower panel along both paths substantially parallel to the longitudinal axis of said master panel and paths transverse to the longitudinal axis of said master panel.

2. A dress pattern template according to claim 1 wherein said first guide means extends along the edge of said one lateral side of said master panel, said second guide means extends along the edge of said upper side of said master panel, said third guide means extends along the edge of said upper side of said upper panel, said fourth guide means extends along the edge of said one lateral side of said upper panel; said fifth guide means extends along the edge of said one lateral side of said lower panel, said sixth guide means extends along the edge of said other lateral side opposite said one side of said lower panel, and said seventh guide means extends along the edge of said lower side of said lower panel.

3. A dress pattern template according to claim 2 further comprising a first scale on one of said master and upper panels for registry with the other of said master and upper panels to indicate bust size.

4. A dress pattern template according to claim 3 further comprising a second scale on one of said master and lower panels for registry with the other of said master and lower panels to indicate the length of the bodice.

5. A dress pattern template according to claim 4 further comprising a third scale on the overlapping portion of one of said upper and lower panels for registry with the overlapping portion of the other of said upper and lower panels to indicate bust size.

6. A dress pattern template according to claim 1 wherein said first adjustable mounting means for securing said upper panel to said master panel comprises a plurality of slots parallel to said second and third guide means in said master and upper panels, respectively, a threaded retaining element mounted on the other of said master and upper panels passing through each of said slots and a threaded knob on each of said threaded retaining elements for securing said master and upper panels together in a selected relationship.

7. A dress pattern template according to claim 6 wherein said second adjustable securing means comprises a plurality of first slots parallel to the axis of said master panel in one of said master and lower panels, a plurality of second slots, equal in number to the number of said first slots, transverse to the axis of said master panel in the other of said master and lower panels and in registry with said first slots, respectively, a threaded retaining element passing through each pair of first and second slots in registry with each other, and a threaded knob for securing said master and lower panels together at a selected position.

8. A dress pattern template according to claim 1 wherein said master, upper and lower panels have a plurality of apertures for marking variations of the pattern for necklines and hems.

* * * * *